US006619929B2

(12) United States Patent
Adaniya et al.

(10) Patent No.: US 6,619,929 B2
(45) Date of Patent: Sep. 16, 2003

(54) ROTATIONAL APPARATUS

(75) Inventors: Taku Adaniya, Kariya (JP); Masahiro Kawaguchi, Kariya (JP); Masaki Ota, Kariya (JP); Takahiro Suzuki, Kariya (JP); Akinobu Kanai, Kariya (JP); Takeshi Kawata, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 10/165,097

(22) Filed: Jun. 6, 2002

(65) Prior Publication Data

US 2002/0187052 A1 Dec. 12, 2002

(30) Foreign Application Priority Data

Jun. 8, 2001 (JP) ..... 2001-173503

(51) Int. Cl.[7] ..... F04B 49/00

(52) U.S. Cl. ..... 417/223; 417/319; 417/374; 310/113

(58) Field of Search ..... 417/223, 313, 417/319, 374, 410.1, 411; 310/113

(56) References Cited

U.S. PATENT DOCUMENTS 4,169,360 A * 10/1979 Shimizu ..... 62/323.2
5,346,370 A * 9/1994 Krohn ..... 417/223
6,244,403 B1 * 6/2001 Ito et al. ..... 192/35
6,247,899 B1 * 6/2001 Ban et al. ..... 417/16
6,375,436 B1 * 4/2002 Irie et al. ..... 417/223

FOREIGN PATENT DOCUMENTS

JP 6-87678 12/1994
JP 2001-020859 1/2001

* cited by examiner

*Primary Examiner*—Cheryl J. Tyler
*Assistant Examiner*—Michael K. Gray
(74) *Attorney, Agent, or Firm*—Morgan & Finnegan, LLP

(57) ABSTRACT

When an electric appliance unit functions as an electric motor, a rotary shaft is rotated by electric current supplied to the electric appliance unit. When the electric appliance unit functions as a generator, the generator generates electricity as the rotary shaft rotates. A first rotation permitting mechanism is located between the rotor and the rotary shaft to permit the rotor and the rotary shaft to rotate relative to each other. A one-way clutch is located between the rotor and the rotary shaft. The one-way clutch permits the rotary shaft to rotate in one direction relative to the rotor and prevents the rotary shaft from rotating in the other direction relative to the rotor. A second rotation permitting mechanism is located between the housing and the rotor. The second rotation permitting mechanism permits the rotor to rotate relative to the housing. Power transmitted from the external drive source to the rotor is transmitted to the rotary shaft via the one-way clutch. The rotor is supported by the housing with the second rotation permitting mechanism.

12 Claims, 4 Drawing Sheets

ROTATIONAL APPARATUS

BACKGROUND OF THE INVENTION

The present invention relates a rotational apparatus that includes an electric appliance unit, which functions as at least one of an electric motor for driving a rotary shaft and a generator, and a power transmitting mechanism for transmitting power to the rotary shaft from a rotor that receives power from an external driver source.

In certain types of vehicles, the engine is automatically stopped when starting idling so that the fuel consumption is reduced. This operation is referred to as idling engine stop operation. For example, Japanese Laid-Open Utility Model Publication No. 6-87678 discloses a hybrid compressor, which performs air conditioning even if the idling engine stop operation is being executed. The hybrid compressor has an electromagnetic clutch located between a pulley and a rotary shaft. A belt receiving portion is formed in the periphery of the pulley. A motor is accommodated inside of the belt receiving portion. To actuate the compressor when the engine is running, the electromagnetic clutch is engaged. This permits the rotary shaft to receive rotational power from the engine through a belt engaged with the belt receiving portion, the pulley, and the clutch. To actuate the compressor when the engine is not running, the clutch is disengaged and the rotary shaft obtains rotational power from the electric motor.

An electromagnetic clutch has relatively large members such as electromagnets and is therefore disadvantageous in reducing the size and the cost of an entire compressor. To continue rotating a rotary shaft of a compressor even if an engine is not running, a one-way clutch may be used instead of the electromagnetic clutch. Providing a one-way clutch in the power transmission path between the pulley and the rotary shaft is more advantageous in reducing the size and the cost of the entire compressor than providing an electromagnetic clutch.

To provide a one-way clutch in the power transmission path between a pulley and a rotary shaft, a bearing needs to be provided between the pulley and the rotary shaft so that the pulley and the rotary shaft rotate with respect to each other. If great load acts on the bearing, the bearing needs to be large and have a great withstand load (a great rated load). A large bearing is disadvantageous in reducing the size and the cost of a rotational apparatus.

SUMMARY OF THE INVENTION

Accordingly, it is an objective of the present invention to provide a rotational apparatus that reduces the size and the cost when a one-way clutch is provided in the power transmission path between a rotor and a rotary shaft.

To achieve the foregoing and other objectives and in accordance with the purpose of the present invention, a rotational apparatus having a housing, a rotary shaft located in the housing, an electric appliance unit, and a power transmitting mechanism is provided. The electric appliance unit functions as at least one of an electric motor and a generator. The power transmitting mechanism transmits power from an external driver source to the rotary shaft via a rotor. When the electric appliance unit functions as the electric motor, the rotary shaft is rotated by electric current supplied to the electric appliance unit. When the electric appliance unit functions as the generator, the generator generates electricity as the rotary shaft rotates. The rotational apparatus includes a first rotation permitting mechanism, a one-way clutch, and a second rotation permitting mechanism. The first rotation permitting mechanism is located between the rotor and the rotary shaft to permit the rotor and the rotary shaft to rotate relative to each other. The one-way clutch is located between the rotor and the rotary shaft. The one-way clutch permits the rotary shaft to rotate in one direction relative to the rotor and prevents the rotary shaft from rotating in the other direction relative to the rotor. The second rotation permitting mechanism is located between the housing and the rotor to permit the rotor to rotate relative to the housing. Power transmitted from the external drive source to the rotor is transmitted to the rotary shaft via the one-way clutch. The rotor is supported by the housing with the second rotation permitting mechanism.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A vehicular rotational apparatus, or a variable displacement compressor, according to a first embodiment of the present invention will now be described with reference to FIGS. 1 to 3.

Figure 1:
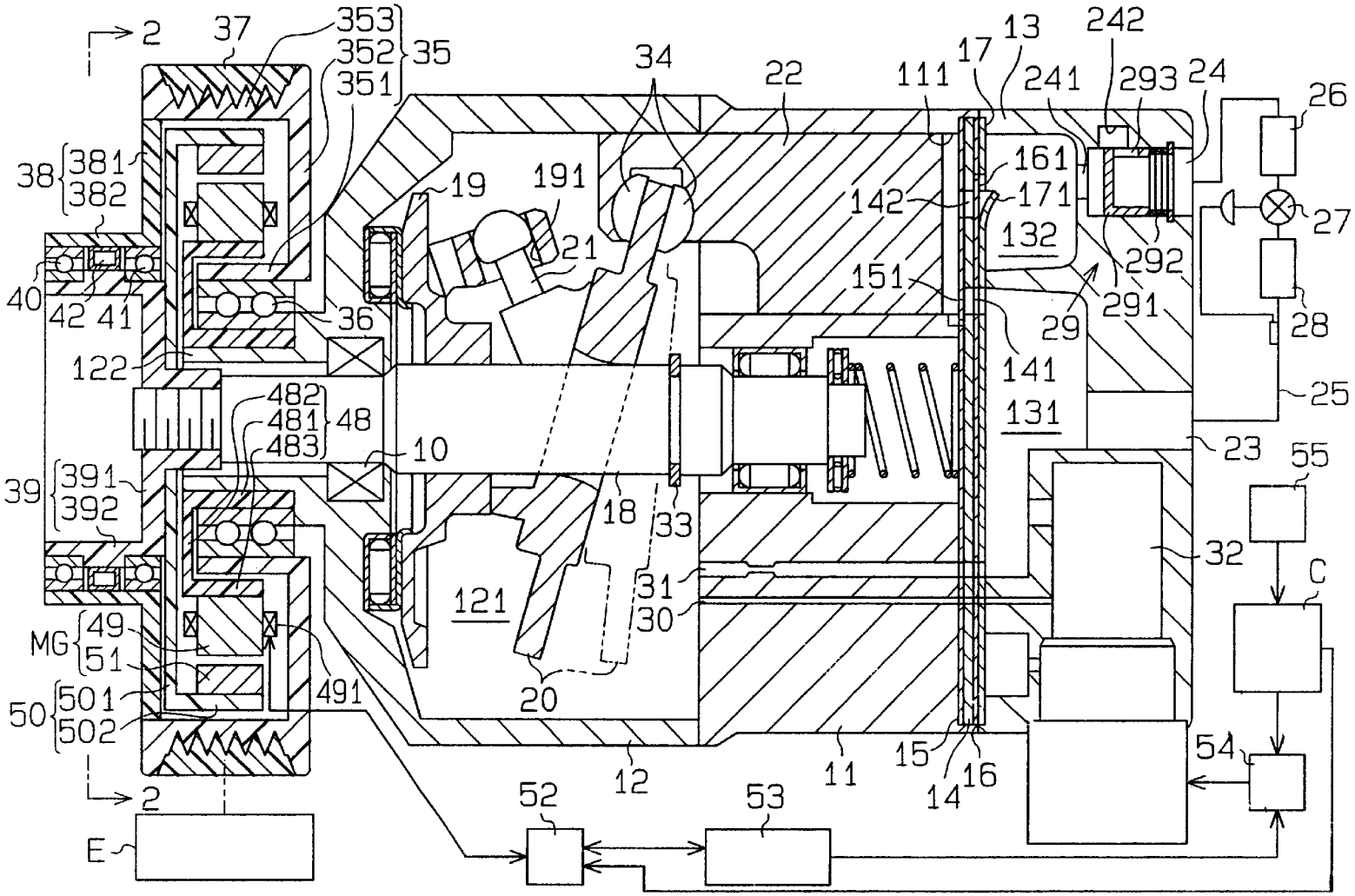
FIG. 1 is a cross-sectional view illustrating a compressor according to a first embodiment.
Figure 2:
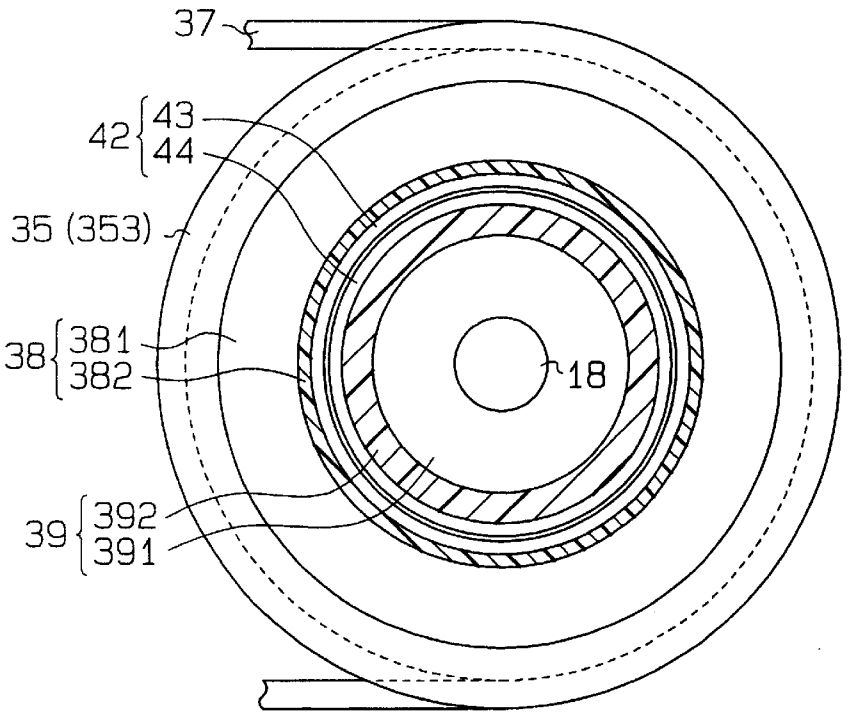
FIG. 2 is a cross-sectional view taken along line 2—2 of FIG. 1.

As shown in FIG. 1, the compressor includes a front housing member 12 and a cylinder block 11, which define a control pressure chamber 121. A rotary shaft 18 is supported by the front housing member 12 and the cylinder block 11. A rotor 19 is fixed to the rotary shaft 18. Also, a swash plate 20 is supported by the rotary shaft 18. The swash plate 20 slides along and inclines with respect to the axis of the rotary shaft 18. Guide pins 21 are secured to the swash plate 20. The guide pins 21 are slidably fitted in guide holes 191 formed in the rotor 19. The engagement between the guide holes 191 and the guide pins 21 permit the swash plate 20 to incline along the axial direction of the rotary shaft 18 and to rotate integrally with the rotary shaft 18.

The maximum inclination angle of the swash plate 20 is defined by abutment of the rotor 19 against the swash plate 20. In FIG. 1, the position of the swash plate 20 depicted by solid lines is the maximum inclination angle position. The minimum inclination angle of the swash plate 20 is defined by abutment between the swash plate 20 and a snap ring 33 fitted about the rotary shaft 18. In FIG. 1, the position of the swash plate 20 depicted by broken lines is the minimum inclination angle position.

Cylinder bores 111 are formed in the cylinder block 11. Each cylinder bore 111 accommodates a piston 22. Each piston 22 is coupled to the swash plate 20 by a pair of shoes 34.

The compressor also has a rear housing member 13, which is attached to the cylinder block 11 with a valve plate assembly in between. A suction chamber 131 and a discharge chamber 132 are defined in the rear housing member 13. The valve plate assembly includes a first valve plate 14, a second valve plate 15, a third valve plate 16, and a retainer plate 17. Sets of suction port 141 and discharge port 142 are formed in the first valve plate 14. Suction valve flaps 151 are formed on the second valve plate 15, and discharge valve flaps 161 are formed on the third valve plate 16. Each suction valve flap 151 corresponds to one of the suction ports 141, and each discharge valve flap 161 corresponds to one of the discharge port 142. Each set of ports 141, 142 corresponds to one of the cylinder bores 111. Retainers 171 are formed on the retainer plate 17. Each retainer 171 corresponds to one of the discharge valve flaps 161.

Rotation of the swash plate 20 is converted into reciprocation of each piston 22. As each piston 22 moves from the top dead center to the bottom dead center, refrigerant gas in the suction chamber 131, which forms the suction pressure zone, is drawn into the associated cylinder bore 111 through the corresponding suction port 141 while flexing the corresponding suction valve flap 151 to an open position. As the piston 22 is moved from the bottom dead center to the top dead center, the refrigerant gas in the cylinder bore 111 is discharged to the discharge chamber 132, which forms the discharge pressure zone, through the corresponding discharge port 142 while flexing the corresponding discharge valve flap 161 to an open position. The discharge valve flap 161 contacts the corresponding retainer 171, which defines the opening degree of the discharge valve flap 161.

A suction passage 23 for introducing refrigerant gas into the suction chamber 131 and a discharge passage 24 for discharging refrigerant gas from the discharge chamber 132 are formed in the rear housing member 13. The suction passage 23 is connected to the discharge passage 24 by an external refrigerant circuit 25. The external refrigerant circuit 25 includes an condenser 26, an expansion valve 27, and an evaporator 28. An outlet valve 29 is located in the discharge passage 24. The outlet valve 29 includes a cylindrical valve body 291. The valve body 291 is urged by a compression spring 292 in the direction for closing a valve hole 241. When the valve body 291 is at the position shown in FIG. 1, refrigerant gas in the discharge chamber 132 flows out to the external refrigerant circuit 25 through the valve hole 241, a bypass passage 242, a communication hole 293, and the interior of the valve body 291. When the valve body 291 closes the valve hole 241, refrigerant gas does not flow out from the discharge chamber 132 to the external refrigerant circuit 25.

The discharge chamber 132 is connected to the control pressure chamber 121 by a supply passage 30. The supply passage 30 sends refrigerant from the discharge chamber 132 to the control pressure chamber 121. The control pressure chamber 121 is connected to the suction chamber 131 by a bleed passage 31. The bleed passage 31 sends refrigerant from the control pressure chamber 121 to the suction chamber 131.

An electromagnetic displacement control valve 32 is located in the supply passage 30. The control valve 32 is used for adjusting the suction pressure in accordance with a level of supplied current. The control valve 32 receives current from a battery 53 through a driver circuit 54. The driver circuit 54 receives commands from a controller C. The controller C commands the driver circuit 54 to control the level of current supplied to the control valve 32 from the battery 53 through the driver circuit 54. Based on temperature information from a temperature sensor 55, which detects the temperature in the passenger compartment, the controller C determines whether the passenger compartment needs to be cooled and controls the current supplied to the control valve 32.

When the level of the current supplied to the control valve 32 is increased, the valve opening degree of the control valve 32 is decreased, which decreases the flow rate of refrigerant supplied from the discharge chamber 132 to the control pressure chamber 121. Since refrigerant gas flows from the control pressure chamber 121 to the suction chamber 131 through the bleed passage 31, the pressure in the control pressure chamber 121 is lowered when the flow rate of refrigerant supplied to the control pressure chamber 121 is decreased. Accordingly, the inclination angle of the swash plate 20 is increased and the displacement of the compressor is increased. An increase in the displacement lowers the suction pressure. When the level of the current supplied to the control valve 32 is lowered, the valve opening degree of the control valve 32 is increased, which increases the flow rate of refrigerant from the discharge chamber 132 to the control pressure chamber 121. Accordingly, the pressure in the control pressure chamber 121 is raised. This decreases the inclination angle of the swash plate 20 and the compressor displacement. A decrease in the displacement raises the suction pressure.

When the level of the current supplied to the control valve 32 is zero, the opening degree of the control valve 32 is maximized, which minimizes the inclination angle of the swash plate 20. In this state, the discharge pressure is low. The force of the compression spring 292 is determined such that the force based on the pressure in a section of the discharge passage 24 that is upstream of the outlet valve 29 when the inclination angle of the swash plate 20 is minimum is less than the sum of the force based on the pressure in the downstream section of the outlet valve 29 and the force of the compression spring 292. Therefore, when the inclination angle of the swash plate 20 is minimum, the valve body 291 closes the valve hole 241, which stops the circulation of refrigerant in the external refrigerant circuit 25. This state, in which the refrigerant circulation is stopped, is the state in which an operation for decreasing thermal load is stopped.

The minimum inclination angle of the swash plate 20 is slightly greater than zero degrees. Since the minimum inclination angle of the swash plate 20 is greater than zero degrees, refrigerant continues being discharged from the cylinder bores 111 to the discharge chamber 132 even if the swash plate 20 is at the minimum inclination angle position. Refrigerant discharged from the cylinder bores 111 to the discharge chamber 132 flows to the control pressure chamber 121 through the supply passage 30. Refrigerant gas in the control pressure chamber 121 flows to the suction chamber 131 through the bleed passage 31. Refrigerant gas in the suction chamber 131 is drawn into the cylinder bores 111 and then discharged to the discharge chamber 132. That is, when the inclination angle is minimum, a circulation passage having the discharge chamber (discharge pressure zone) 132, the supply passage 30, the control pressure chamber 121, the bleed passage 31, the suction chamber (the suction pressure zone) 131, and the cylinder bores 111 is formed. There are pressure differences among the discharge chamber 132, the control pressure chamber 121, and the suction chamber 131. Thus, refrigerant gas circulates in the circulation passage, which lubricates the interior of the compressor with lubricant in the refrigerant gas.

A cylindrical projection 122 is formed in the front portion of the front housing member 12. The rotary shaft 18 protrudes from the housing through the cylindrical projection 122. A seal member 10 seals the control pressure chamber 121. A double-cylindrical support member 48 is fitted about and fixed to the cylindrical projection 122. The support member 48 includes a cylindrical boss 481. A synthetic resin pulley 35 is supported by the boss 481 with a second rotation permitting mechanism, which is a radial bearing 36 in this embodiment, so that the pulley 35 rotates with respect to the boss 481. The pulley 35 includes a cylindrical boss 351, a flange 352, and a power receiving portion, which is a belt receiving portion 353 in this embodiment. The cylindrical boss 351 is fitted to the radial bearing 36. The flange 352 is integrally formed with an end of the boss 351. The belt receiving portion 353 is integrally formed with the periphery of the flange 352. A belt 37 is engaged with the belt receiving portion 353. The rotational power of a vehicle engine E is transmitted to the pulley 35 by the belt 37.

An annular first power transmitting body 38, which is made of synthetic resin, is fitted in and fixed to the inner circumference of the belt receiving portion 353. An annular second power transmitting body 39, which is made of synthetic resin, is threaded to the distal end of the rotary shaft 18. As shown in FIG. 2, the first power transmitting body 38 includes an annular plate 381 and an outer cylindrical portion 382. The outer cylindrical portion 382 is integrally formed with the inner circumference of the annular plate 381. The second power transmitting body 39 includes an annular plate 391 and an inner cylindrical portion 392. The inner cylindrical portion 392 is integrally formed with the outer circumference of the annular plate 391.

As shown in FIG. 1, the outer and inner cylindrical portions 382, 392 protrude away from the front housing member 12. The outer cylindrical portion 382 surrounds the inner cylindrical portion 392. A first rotation permitting mechanism, which is a pair of radial bearings 40, 41, is located between the outer cylindrical portion 382 and the inner cylindrical portion 392. The radial bearings 40, 41 permit the first and second power transmission bodies 38, 39 to be rotated with respect to each other.

A one-way clutch 42 is located between the outer cylindrical portion 382 and the inner cylindrical portion 392 and between the radial bearings 40 and 41. The belt receiving portion 353 functions as a power receiving portion for receiving rotational power from the vehicle engine E, which functions as an external drive source. A region surrounded by the belt receiving portion 353 is referred to as a rotation encircled region (rotation path). The one-way clutch 42 is located outside of the rotation encircled region. In this invention, the rotation encircled region refers to a region that is surrounded by the power receiving portion, which is rotated by the rotational power supplied by an external drive source.

Figure 3A:
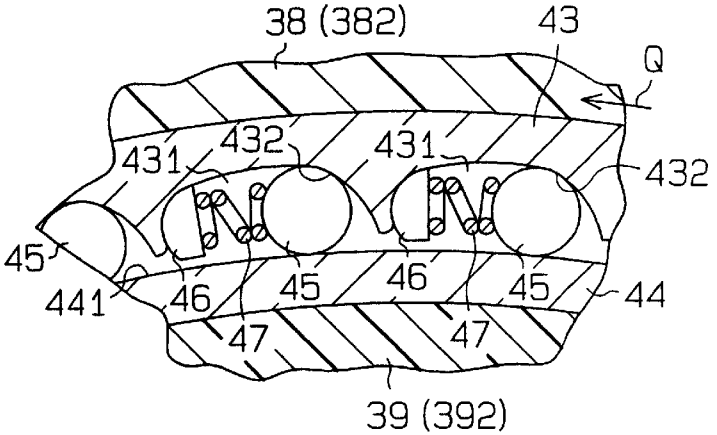
FIGS. 3(*a*) and 3(*b*) are enlarged cross-sectional views illustrating the one-way clutch of FIG. 1.
Figure 3B:
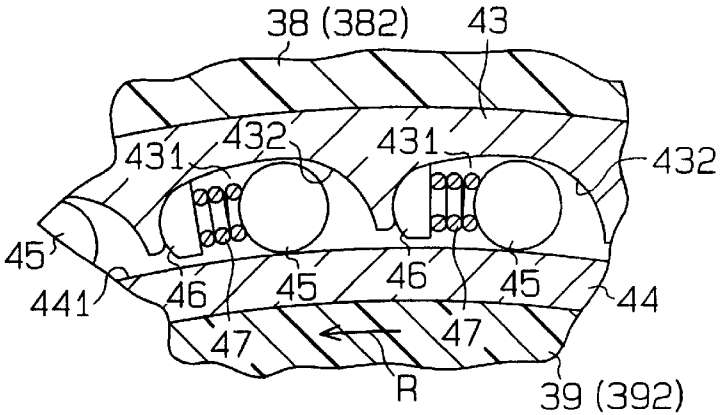

FIGS. 3(*a*) and 3(*b*) illustrates the one-way clutch 42 located between the outer cylindrical portion 382 and the inner cylindrical portion 392. The one-way clutch 42 includes an annular outer housing member 43 and an annular inner housing member 44. The outer housing member 43 is fitted and fixed to the outer cylindrical portion 382. The inner housing member 44 is fitted and fixed to the inner cylindrical portion 392. The outer housing member 43 surrounds the inner housing member 44. Recesses 431 are formed in the inner surface of the outer housing members 43. The recesses 431 are spaced at equal angular intervals. A roller 45 and a spring seat 46 are accommodated in each recess 431. A compression spring 47 extends between the roller 45 and the spring seat in each recess 431.

A power transmitting surface 432 is formed in each recess 431. The compression spring 47 urges the roller 45 toward the power transmitting surface 432. When the first power transmitting body 38, or the pulley 35, is rotating in the direction indicated by arrow Q shown in FIG. 3(*a*), each roller 45 contacts the corresponding power transmitting surface 432, which drives the roller 45 into the space between the power transmitting surface 432 and a power transmitting circumferential surface 441 of the inner housing member 44. Accordingly, the second power transmitting body 39 and the rotary shaft 18 rotate integrally with the first power transmitting body 38. The pulley 35, the first power transmitting body 38, the one-way clutch 42 and the second power transmitting body 39 form a power transmitting mechanism, which transmits power from the engine E, which functions as an external drive source, to the rotary shaft 18.

While the first power transmitting body 38 (the pulley 35) is not rotating, if the second power transmitting body 39 rotates in the direction indicated by arrow R shown in FIG. 3(*b*), each roller 45 is moved away from the corresponding power transmitting surface 432 against the force of the corresponding compression spring 47. Therefore, the first power transmitting body 38 is not rotated along with the second power transmitting body 39. Specifically, the one-way clutch 42 permits the rotary shaft 18 to rotate in one direction (the direction indicated by arrow R) relative to the pulley 35, which functions as a rotor. The one-way clutch 42, however, prevents the rotary shaft 18 from rotating in the other direction (the direction opposite from the direction of arrow R) relative to the pulley 35.

As shown in FIG. 1, the support member 48 is fitted to the cylindrical portion 122 of the front housing 12. The support body 48 includes the boss 481. A flange 482 is integrally formed with the boss 481. A cylindrical support 483 is integrally formed with the outer circumference of the flange 482. The cylindrical support 483 surrounds the boss 481 and the cylindrical boss 351 of the pulley 35. A stator 49 is fixed to the outer circumference of the cylindrical support 483.

A synthetic resin annular support 50 is attached to the back of the annular plate 391 of the second power transmitting body 39. The support 50 includes an annular plate 501 and a cylindrical section 502, which is integrally formed with the outer circumference of the annular plate 501. A rotor 51 is fixed to the inner surface of the cylindrical section 502. The stator 49, the rotor 51, and the supports 48, 50 form a motor-generator MG, which functions as an electric motor and a generator. The motor-generator MG, which functions as an electric appliance unit, is located within the region surrounded by the belt receiving portion 353, which functions as a power receiving portion, or within the rotation encircled region of the belt receiving portion 353.

The stator 49 includes a coil 491, which is electrically connected to the battery 53 through the driver circuit 52. The driver circuit 52 receives command signals from the controller C. The controller C commands the driver circuit 52 either to control charging of the battery 53 by the coil 491 through the driver circuit 52 or power supply to the coil 491 by the battery 53 through the driver circuit 52.

When the engine E is running, the pulley 35 rotates in the direction indicated by arrow Q in FIG. 3(*a*). In this state, the rotary shaft 18 also rotates in the direction of arrow Q. Therefore, the rotor 51 rotates in the same direction to cause the coil 491 to generate electricity. The controller C commands the driver circuit 52 to control charging of the battery 53 from the coil 491 through the driver circuit 52. The electricity generated by the coil 491 is sent to the battery 53 through the driver circuit 52 and is charged by the battery 53.

When the engine E is not running, the controller C determines whether the passenger compartment needs to be cooled based on temperature information from the temperature detector 55. Accordingly, the controller C controls electricity supplied from the battery 53 to the coil 491. When cooling is needed, the controller C supplies electricity from the battery 53 to the coil 491, which rotates the rotor 51 in the direction indicated by arrow R in FIG. 3(*b*). Rotation of the rotor 51 rotates the rotary shaft 18, which allows the compressor to operate even if the engine E is not running.

The first embodiment has the following advantages.

(1-1) The rated load of the radial bearings 40, 41 located between the pulley 35 and the rotary shaft 18 needs to be increased as the load acting on the bearings 40, 41 is increased. As the rated load is increased, the size and the costs of the radial bearings 40, 41 are increased. Because of the conditions on the side of vehicles, the size of a vehicular compressor, which functions as a rotational apparatus, must be prevented from being increased.

Since the pulley 35 is supported by the cylindrical portion 122 of the front housing member 12 with the radial bearing 36, the load acting on the pulley 35 is not entirely received by the radial bearings 40, 41. Therefore, the rated load of the radial bearings 40, 41, which are located between the pulley 35 and the rotary shaft 18, does not need to be great enough to receive the entire load acting on the pulley 35. Thus, the radial bearings 40, 41 need not be large and expensive. This is effective in reducing the size and the cost of the compressor, which functions as a rotational apparatus.

(1-2) The motor-generator MG functions as an electric motor and rotates the rotary shaft 18 as needed even if the engine E is not running. Therefore, the passenger compartment is air-conditioned even if the engine E is not running.

(1-3) If the one-way clutch 42 is located in the rotation encircled region of the belt receiving portion 353, the motor generator MG may be located within the rotation encircled region of the belt receiving portion 353. However, this structure would reduce the space for the motor-generator MG in the rotation encircled region of the belt receiving portion 353, and a motor-generator MG having a great power cannot be used. In the illustrated embodiment, the one-way clutch 42 is located outside of the rotation encircled region of the belt receiving portion 353. This structure increases the space for the motor-generator MG in the rotation encircled region of the belt receiving portion 353 and therefore permits a large motor-generator MG having a great power to be located in the rotation encircled region of the belt receiving portion 353. That is, since the one-way clutch 42 is located outside the rotation encircled region of the pulley 35, the power of the motor-generator MG may be increased without increasing the size of the compressor.

(1-4) In the variable displacement compressor of the above illustrated embodiment, the outlet valve 29 is closed when the swash plate 20 is at the minimum inclination angle position to stop the circulation of refrigerant in the external refrigerant circuit 25. In this state, the rotational power of the engine E is transmitted to the rotary shaft 18 and the rotary shaft 18 is rotating. When there is no circulation of refrigerant in the external refrigerant circuit 25, or when there is no air conditioning, the compressor preferably receives the smallest possible torque. When there is no circulation of refrigerant in the external refrigerant circuit 25, the compressor of the above embodiment receives a significantly small torque.

In the illustrated embodiment, the one-way clutch 42 is located between the engine E and the rotary shaft 18. Compared to a case where an electromagnetic clutch is used, the compressor of the above embodiment is smaller and lighter. Since the compressor of the embodiment has no electromagnetic clutch and stops circulation of refrigerant in the external refrigerant circuit when the swash plate 20 at the minimum inclination angle position, the present invention is suitable for the compressor.

(1-5) The pulley 35, the power transmitting bodies 38, 39, and the supports 48, 50 are made of synthetic resin, which reduces the weight of the compressor.

Figure 5:
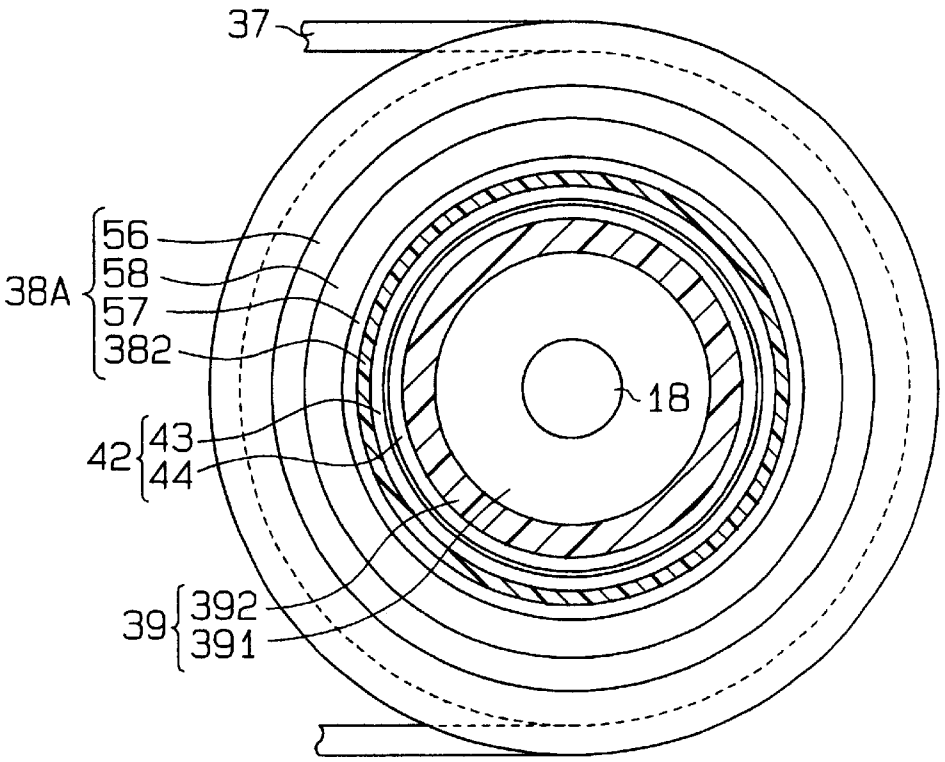
FIG. 5 is a cross-sectional view taken along line 5—5 of FIG. 4.
Figure 4:
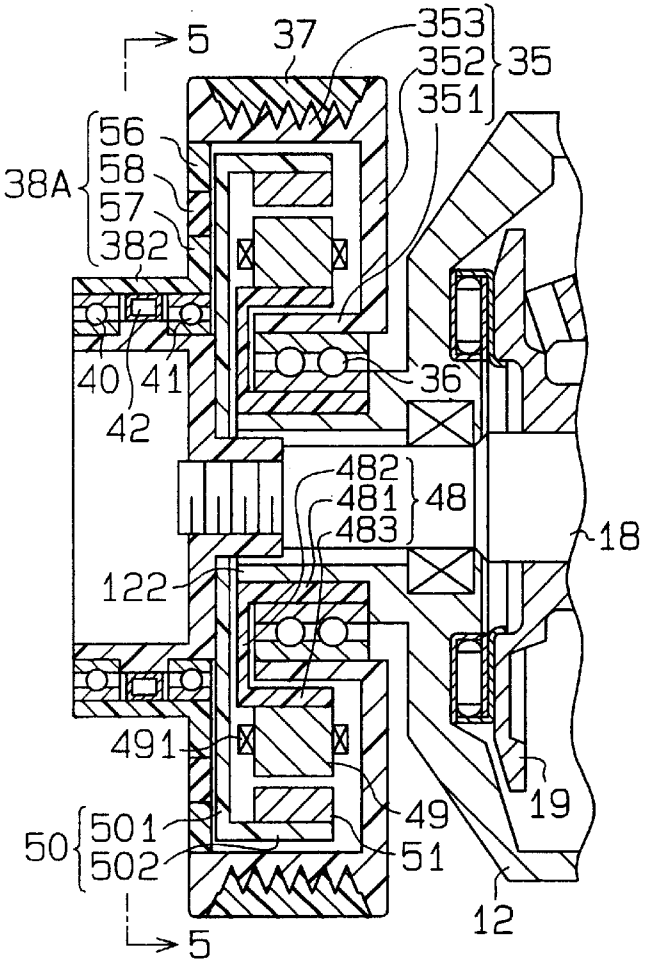
FIG. 4 is a partial cross-sectional view illustrating an apparatus according to a second embodiment.

A second embodiment of the present invention will now be described with reference to FIGS. 4 and 5. Like or the same reference numerals are given to those components that are like or the same as the corresponding components of the first embodiment.

Rotation of the pulley 35 is transmitted to the rotary shaft 18 by a power transmitting body 38A. The power transmitting body 38A includes an outer transmission ring 56, an inner transmission ring 57, and a rubber shock-absorbing ring 58, which is located between the outer transmission ring 56 and the inner transmission ring 57. The shock-absorbing ring 58 is fitted inside of the outer transmission ring 56 and about the inner transmission ring 57. The shock-absorbing ring 58 is a shock absorbing body, which is located in the power transmission path between the pulley 35 and the one-way clutch 42.

The shock-absorbing ring 58 reduces the fluctuations of torque transmitted to the engine E from the rotary shaft 18. The shock-absorbing ring 58 is located upstream of the one-way clutch 42 in the power transmission path. Thus, most of the load acting on the pulley 35 is received by the radial bearing 36. Therefore, the rated load of the radial bearings 40, 41, which are located between the pulley 35 and the rotary shaft 18, is less than that of the first embodiment. This permits the sizes of the radial bearings 40, 41 to be further reduced.

Also, the shock-absorbing ring 58 automatically aligns the rotational axis of the rotary shaft 18 with the axis of the radial bearing 36. That is, when assembling the compressor, the alignment of the axis of the rotary shaft 18 and the axis of the radial bearing 36 does not need to be extremely accurate.

Figure 6:
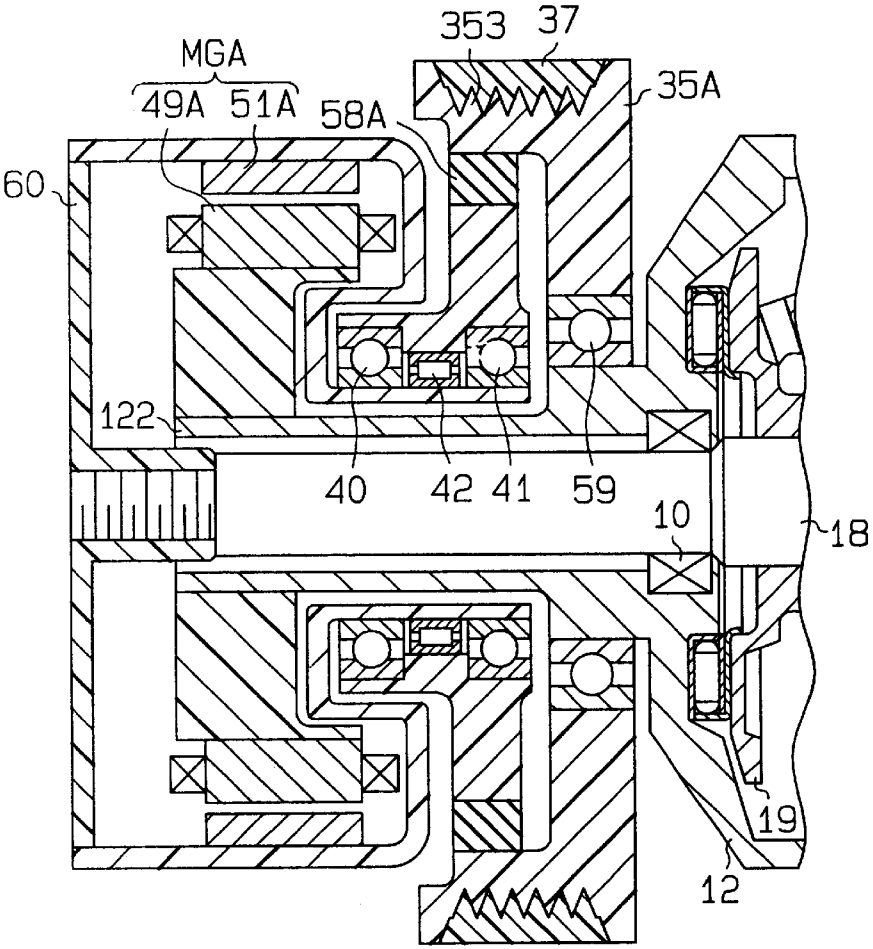
FIG. 6 is a partial cross-sectional view illustrating an apparatus according to a third embodiment.

As in a third embodiment shown in FIG. 6, a stator 49A and a rotor 51A may be located outside the rotation encircled region of the belt receiving portion 353. The stator 49A and the rotor 51A are part of a motor generator MGA and are accommodated in a cover 60 for transmitting power. A pulley 35A is supported by the cylindrical portion 122 of the front housing member 12 with a radial bearing 59. Rotation of the pulley 35A is transmitted to the rotary shaft 18 through the shock-absorbing ring 58A, the one-way clutch 42, and the cover 60.

The third embodiment has the advantages (1-1), (1-2), and (1-4) of the first embodiment.

Figure 7:
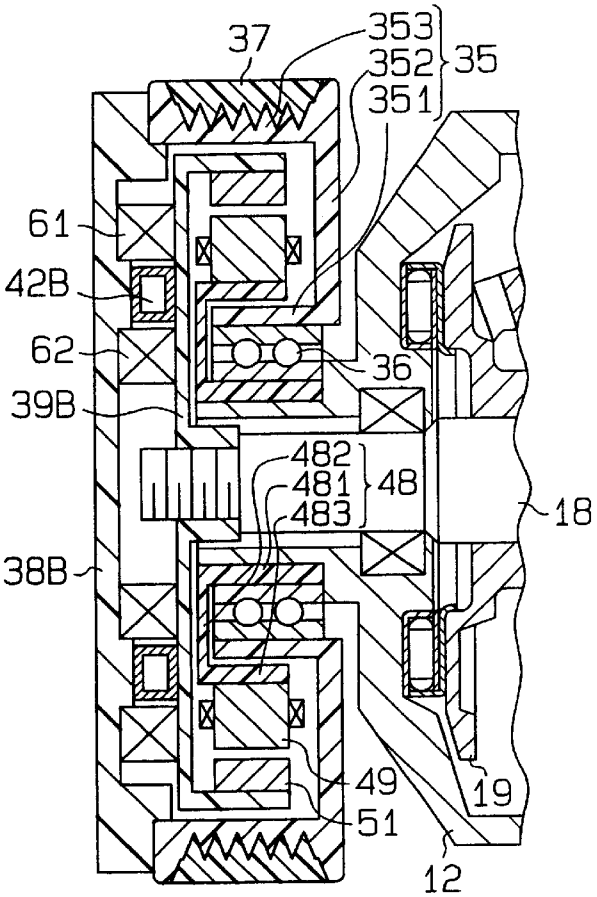
FIG. 7 is a partial cross-sectional view illustrating an apparatus according to a fourth embodiment.

A fourth embodiment according to the present invention will now described with reference to FIG. 7. Like or the same reference numerals are given to those components that are like or the same as the corresponding components of the first embodiment.

A second power transmitting body 39B is threaded to the rotary shaft 18 and supports the rotor 51. A disk-shaped first power transmitting body 38B is fixed to the pulley 35. Thrust bearings 61, 62 are located between the first power transmitting body 38B and the second power transmitting body 39B. Also, a one-way clutch 42B is located between the first power transmitting body 38B and the second power transmitting body 39B. Rotation of the pulley 35 is transmitted to the rotary shaft 18 by the first power transmitting body 38B, the one-way clutch 42B, and the second power transmitting body 39B. The one-way clutch 42B has the same functions as those of the one-way clutch 42 of the first to third embodiments.

The fourth embodiment has the advantages (1-1), (1-2), and (1-4) of the first embodiment.

It should be apparent to those skilled in the art that the present invention may be embodied in many other specific forms without departing from the spirit or scope of the invention. Particularly, it should be understood that the invention may be embodied in the following forms.

In the first embodiment, one of the radial bearings 40, 41 may be omitted.

The electric appliance unit may function only as an electric motor.

The electric appliance unit may function only as a generator.

The electric appliance unit may be located outside the rotation encircled region of the belt receiving portion 353 and at a position closer to the front housing member 12 than the belt receiving portion 353 is.

The present invention may be applied to a variable displacement compressor in which circulation of refrigerant in the external refrigerant circuit 25 is not stopped when the rotary shaft 18 is rotating and the swash plate 20 is at the minimum inclination angle position.

The present invention may be applied to a compressor other than that in the illustrated embodiment. For example, the present invention may be applied to a scroll-type compressor or a vane compressor.

The present invention may be applied to any rotational apparatus other than compressors as long as the rotational apparatus includes an electric appliance unit that functions as at least one of an electric motor for driving a rotary shaft and a generator and a power transmitting mechanism for transmitting power to the rotary shaft from a rotor receiving power from an external drive source.

Therefore, the present examples and embodiments are to be considered as illustrative and not restrictive and the invention is not to be limited to the details given herein, but may be modified within the scope and equivalence of the appended claims.

What is claimed is:

1. A rotational apparatus comprising a housing, a rotary shaft located in the housing, an electric appliance unit, which functions as at least one of an electric motor and a generator, and a power transmitting mechanism for transmitting power from an external driver source to the rotary shaft via a rotor, wherein, when the electric appliance unit functions as the electric motor, the rotary shaft is rotated by electric current supplied to the electric appliance unit, wherein, when the electric appliance unit functions as the generator, the generator generates electricity as the rotary shaft rotates, wherein the rotational apparatus includes:

a first rotation permitting mechanism located between the rotor and the rotary shaft to permit the rotor and the rotary shaft to rotate relative to each other;

a one-way clutch located between the rotor and the rotary shaft, wherein the one-way clutch permits the rotary shaft to rotate in one direction relative to the rotor and prevents the rotary shaft from rotating in the other direction relative to the rotor; and a second rotation permitting mechanism located between the housing and the rotor to permit the rotor to rotate relative to the housing;

wherein power transmitted from the external drive source to the rotor is transmitted to the rotary shaft via the one-way clutch, and wherein the rotor is supported by the housing with the second rotation permitting mechanism.

2. The rotational apparatus according to claim 1, wherein the electric appliance unit functions at least as the electric motor.

3. The rotational apparatus according to claim 1, wherein the rotor has a power receiving portion at the outer circumferential portion, wherein the one-way clutch is located outside of the rotation path of the power receiving portion.

4. The rotational apparatus according to claim 1, wherein an elastic shock-absorbing body is located in a power transmission path between the rotor and the one-way clutch.

5. The rotational apparatus according to claim 1, wherein the rotational apparatus is a variable displacement compressor that controls the displacement to be varied.

6. The rotational apparatus according to claim 5, wherein the compressor includes a swash plate located in a control pressure chamber and a plurality of pistons located about the rotary shaft, wherein the swash plate rotates integrally with and inclines with respect to the rotary shaft, wherein the pistons reciprocate in accordance with the inclination angle of the swash plate, wherein the inclination angle of the swash plate is controlled by controlling the pressure in the control pressure chamber.

7. The rotational apparatus according to claim 6, wherein, when the swash plate is at a minimum inclination angle position while the rotary shaft is rotating, circulation of refrigerant in an external refrigerant circuit is stopped.

8. A compressor comprising:

a housing, in which a control pressure chamber is defined;

a rotary shaft located in the housing;

a swash plate accommodated in the control pressure chamber, wherein the swash plate rotates integrally with and inclined with respect to the rotary shaft;

a plurality of pistons arranged in the housing to be located about the rotary shaft, wherein the pistons reciprocate in accordance with the inclination angle of the swash plate;

an electric appliance unit, which functions as at least one of an electric motor and a generator;

a power transmitting mechanism for transmitting power from an external driver source to the rotary shaft via a rotor wherein, when the electric appliance unit functions as the electric motor, the rotary shaft is rotated by electric current supplied to the electric appliance unit, wherein, when the electric appliance unit functions as the generator, the generator generates electricity as the rotary shaft rotates;

a first rotation permitting mechanism located between the rotor and the rotary shaft to permit the rotor and the rotary shaft to rotate relative to each other;

a one-way clutch located between the rotor and the rotary shaft, wherein the one-way clutch permits the rotary shaft to rotate in one direction relative to the rotor and prevents the rotary shaft from rotating in the other direction relative to the rotor;

a second rotation permitting mechanism located between the housing and the rotor to permit the rotor to rotate relative to the housing; and wherein power transmitted from the external drive source to the rotor is transmitted to the rotary shaft via the one-way clutch, and wherein the rotor is supported by the housing with the second rotation permitting mechanism.

9. The compressor according to claim 8, wherein the electric appliance unit functions at least as the electric motor.

10. The compressor according to claim 8, wherein the rotor has a power receiving portion at the outer circumferential portion, wherein the one-way clutch is located outside of the rotation path of the power receiving portion.

11. The compressor according to claim 8, wherein an elastic shock-absorbing body is located in a power transmission path between the rotor and the one-way clutch.

12. The compressor according to claim 8, further comprising an external refrigerant circuit, wherein, when the swash plate is at a minimum inclination angle position while the rotary shaft is rotating, circulation of refrigerant in the external refrigerant circuit is stopped.

* * * * *